US010746429B2

(12) United States Patent
Li et al.

(10) Patent No.: US 10,746,429 B2
(45) Date of Patent: Aug. 18, 2020

(54) SYSTEM AND METHOD FOR CONTROLLING TEMPERATURE IN A BUILDING

(71) Applicant: Consumer 2.0 Inc., Los Angeles, CA (US)

(72) Inventors: Zhe Clark Li, Thousand Oaks, CA (US); Chunmeng Han, Thousand Oaks, CA (US)

(73) Assignee: CONSUMER 2.0 INC., Los Angeles, CA (US)

( * ) Notice: Subject to any disclaimer, the term of this patent is extended or adjusted under 35 U.S.C. 154(b) by 0 days.

(21) Appl. No.: 16/171,333

(22) Filed: Oct. 25, 2018

(65) Prior Publication Data

US 2020/0132325 A1 Apr. 30, 2020

(51) Int. Cl.

| | |
|---|---|
| ***F24F 11/52*** | (2018.01) |
| ***G08C 17/00*** | (2006.01) |
| ***F24F 11/56*** | (2018.01) |
| ***F24F 11/63*** | (2018.01) |
| ***F24F 11/65*** | (2018.01) |

(52) U.S. Cl.

CPC ..... *F24F 11/52* (2018.01); *F24F 11/56* (2018.01); *F24F 11/63* (2018.01); *F24F 11/65* (2018.01); *G08C 17/00* (2013.01); *G08C 2201/93* (2013.01)

(58) Field of Classification Search

CPC ..... F24F 11/52; F24F 11/523; F24F 11/526; F24F 11/56; F24F 11/57; F24F 11/58; F24F 11/63; F24F 11/65; F24F 11/80; F24F 2110/10; G08C 17/00; G08C 17/02; G08C 2201/93

USPC ..... 340/12.15

See application file for complete search history.

(56) References Cited

U.S. PATENT DOCUMENTS

| | | | | |
|---|---|---|---|---|
| 5,926,776 | A * | 7/1999 | Glorioso | G05D 23/1923 236/46 R |
| 2007/0099643 | A1* | 5/2007 | Almeda | H04M 1/72533 455/519 |
| 2010/0023865 | A1* | 1/2010 | Fulker | G06F 3/04817 715/734 |
| 2011/0205965 | A1* | 8/2011 | Sprigg | G06F 9/4411 370/328 |
| 2014/0126425 | A1* | 5/2014 | Burd | H04L 12/4633 370/255 |
| 2014/0313882 | A1* | 10/2014 | Rucker | H04W 4/70 370/219 |
| 2016/0040903 | A1* | 2/2016 | Emmons | H04L 67/1078 700/278 |
| 2016/0197772 | A1* | 7/2016 | Britt | H04W 4/70 370/254 |

(Continued)

*Primary Examiner* — Edwin C Holloway, III
(74) *Attorney, Agent, or Firm* — Eagle IP Limited; Jacqueline C. Lui

(57) ABSTRACT

One example embodiment is a smart thermostat hub for controlling temperature. The smart thermostat hub includes a processor, a cellular communications unit and a temperature control unit. The cellular communications unit is in electronic communication with the processor and is configured to receive a remote command over a wide area communications network. The temperature control unit is configured to modify a temperature control setting based at least in part on the remote command.

17 Claims, 4 Drawing Sheets

(56) References Cited

U.S. PATENT DOCUMENTS

2016/0327299 A1* 11/2016 Ribbich ..... F24F 11/30
2017/0314798 A1* 11/2017 Steinberg ..... F24F 11/30

* cited by examiner

SYSTEM AND METHOD FOR CONTROLLING TEMPERATURE IN A BUILDING

FIELD OF INVENTION

This invention relates to a system and method for controlling the temperature of one or more units in a building.

BACKGROUND OF INVENTION

Demand for temperature control of buildings to increase energy efficiency is increasing. New systems and methods that assist in advancing technological needs and industrial applications in controlling the temperature in a building are desirable.

SUMMARY OF INVENTION

One example embodiment is an apparatus for controlling temperature. The apparatus includes a processor, a cellular communications unit and a temperature control unit. The cellular communications unit is in electronic communication with the processor and is configured to receive a remote command over a wide area communications network. The temperature control unit is configured to modify a temperature control setting based at least in part on the remote command.

Another example embodiment includes a method for controlling a thermostat. The method includes receiving a remote command over a wide area communications network at the thermostat, and modifying a temperature control setting of the thermostat based at least in part on the remote command.

In a further example embodiment, a method is provided to control the temperature of one or more locations. The method includes receiving a wireless remote command over a cellular communications network in at least one thermostat hub; transforming the wireless remote command into a wired electronic signal in a processor provided within the thermostat hub; and sending the wired electronic signal from the processor to a thermostat provided in the thermostat hub to control the temperature using a thermostat.

Other example embodiments are discussed herein.

DETAILED DESCRIPTION

Figure 1:
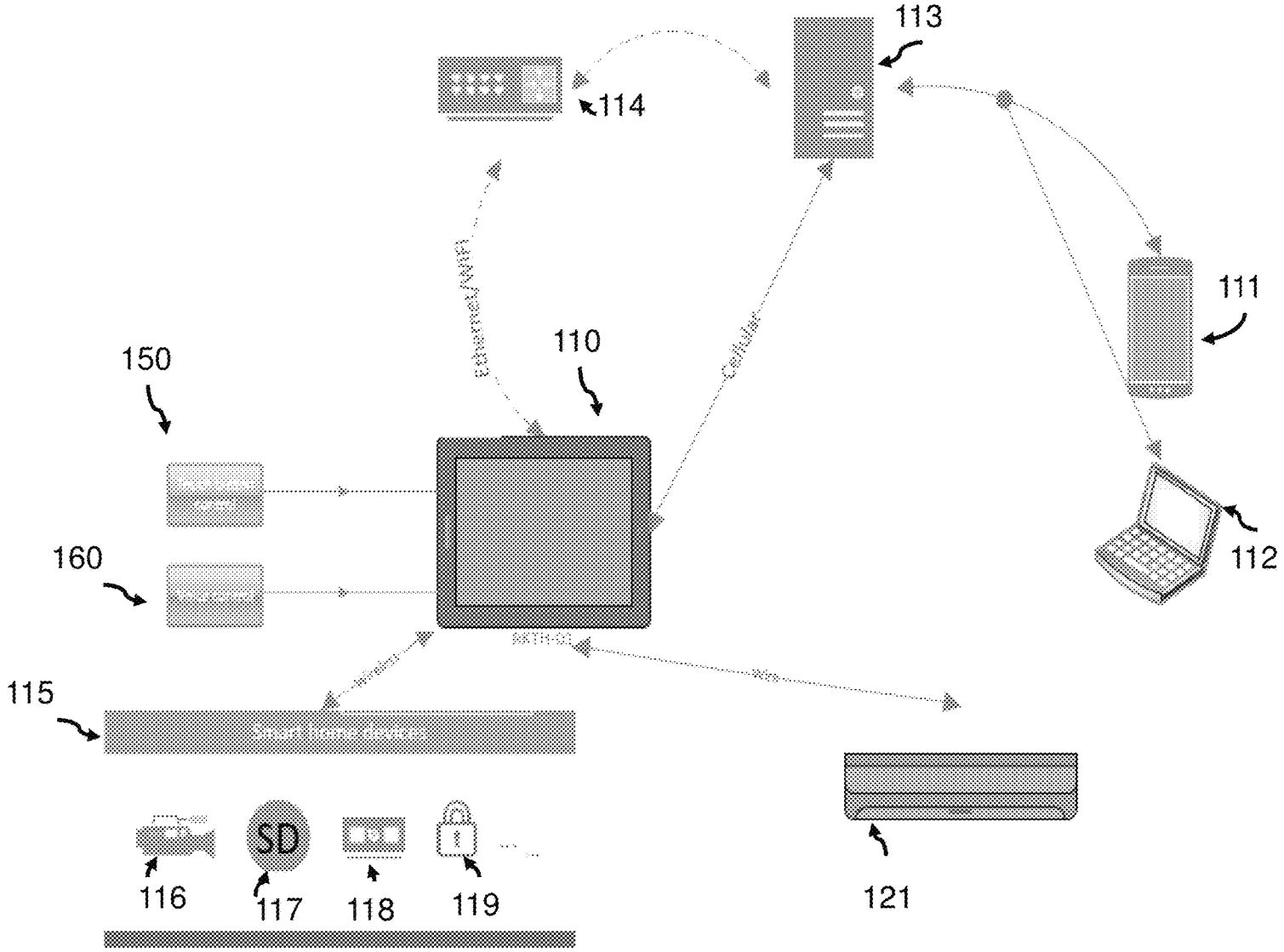
FIG. 1 shows a smart thermostat hub in accordance with an example embodiment.

As used herein and in the claims, "comprising" means including the following elements but not excluding others.

As used herein, "wide area network" is a telecommunications network including the local area network and cellular communication network.

As used herein, a "gateway" is a passage to connect two networks together that may work upon different networking models. They work as the messenger agents that take data from one system, interpret it, and transfer it to another system. Gateways are also called protocol converters and can operate at any network layer.

As used herein, "Ethernet" is a family of computer networking technologies commonly used in local area network.

As used herein, "Long-Term Evolution (LTE)" is a standard for high-speed wireless communication for mobile devices and data terminals.

A thermostat is used to sense the temperature of a physical unit and a thermostat hub performs actions, such as controlling the heating and/or air conditioning, so that the unit's temperature is maintained near a desired setpoint. Example embodiments of the present invention provide various thermostat hubs that allow operation by different wired and wireless technologies and improves efficiency in temperature management of the unit.

The present invention allows a physical system to effectively carry out its daily function regardless of the location of the operator. In situations where the operator does not have access to the local area network or where there is no local area network available, the operator can use a cellular communications network to send a remote command to the thermostat hub of the example embodiment. The thermostat hub includes a thermostat and communicates with one or more appliances over the local area network in the physical system.

Existing smart hubs control a variety of activities such as turning lights and appliance on and off and they connect to the Ethernet by a physical cable and further connect to the appliances by networks. Separately, existing thermostat hubs only control the temperature of a unit. Example embodiments provide an apparatus that incorporates a smart hub and a thermostat hub in a single circuit board using a processor to control the temperature of a unit and at the same time control the application of the appliances in the unit.

Furthermore, the present invention allows home automation in every apartment of a building by a single system and enhances benefits including labor savings, time savings and improvements to quality, accuracy and precision. By way of example, when a property agency wants to unlock a door lock of an apartment for a potential tenant to visit, the property agency sends a wireless remote command to the thermostat hub of the example embodiment in the apartment and the thermostat hub controls the door lock by sending command signal from the local communication unit installed in the thermostat hub to the door lock. He may also be able to switch on the AC or heater first before the appointment time to adjust the apartment to the right temperature before the potential tenant enters it.

Referring now to FIG. 1, the first embodiment of the present invention is a smart thermostat hub 110. The smart thermostat hub 110 includes a touchscreen and a microphone that are installed on a wall of a physical unit. The smart thermostat hub 110 houses a temperature control unit, a local communications unit, a cellular communications unit and a processor. A user can give input through simple or multi-touch gestures by touching the touchscreen which is connected with a touch button control 150. The touch button control 150 determines whether the gesture complies with a preset condition to send a local command to the temperature control unit installed in the smart thermostat hub 110. The user can also give input by speaking to the microphone and the audio captured by the microphone is analyzed through a voice control 160 connected to the microphone. The voice control 160 produces another local command based on the analysis to send the local command to the temperature control unit. The temperature control unit is configured to modify the temperature control setting that adjusts an air conditioner 121 of the physical unit based at least in part on the local commands. The air conditioner 121 is wired connected to the smart thermostat hub 110.

The user can use a smart phone 111 or a computer 112 to control the smart thermostat hub 110 in any remote location away from the physical unit. By giving input to the smart phone 111 or the computer 112, a remote command is sent through a server 113 to the smart thermostat hub 110 over a wide area communications network. The wide area communications network includes the cellular communications network and the local area network. As such, the user has option 1: controlling the smart thermostat hub 110 by cellular communication when local area network is not available and has option 2: controlling the smart thermostat hub 110 by local area network when it is available. The cellular communications unit in the smart thermostat hub 110 is configured to receive the remote command over the cellular communications network from the server 113. The local communications unit in the smart thermostat hub 110 is configured to receive the remote command over a local area network from the server 113 through a gateway 114. By way of example, the local area network is Wifi or Ethernet. The cellular communications unit and the local communications unit in the smart thermostat hub 110 are in electronic communication with the processor in the smart thermostat hub 110 which sends a signal to the temperature control unit in the smart thermostat hub 110 to modify the temperature control setting based at least in part on the remote command.

The smart thermostat hub 110 is wireless connected to smart home devices 115 including a camera 116, a smoke detector 117, a switch 118, a lock 119 etc. The user can control the smart home devices 115 by sending the remote command via the option 1 and/or the option 2 to the smart thermostat hub 110, or by sending the local command using the touchscreen or the microphone in the smart thermostat hub 110. The remote command and the local command received will be processed in the processor and the processor will send a signal to the local communications unit in the thermostat hub 110. The local communications unit in the thermostat hub 110 communicates with the smart home devices 115 over the local area network. By way of example, the local area network includes but not limited to a WiFi network, a Bluetooth network, a ZigBee network, a WeMo network, a Thread network, and a Z-wave network.

Figure 2:
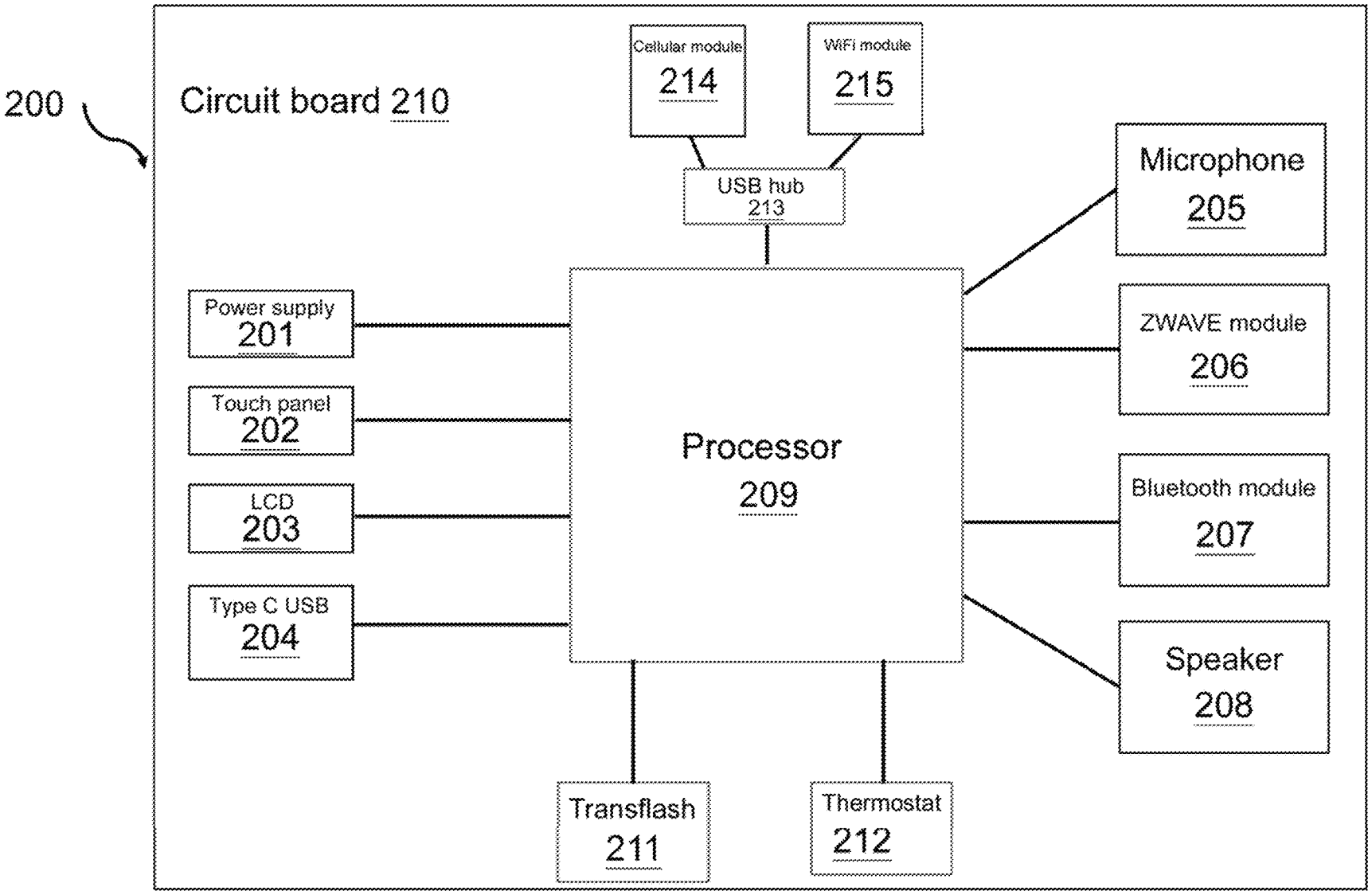
FIG. 2 shows a hub for controlling temperature in accordance with an example embodiment.

Referring now to FIG. 2, another example embodiment of the present invention is a hub 200 for controlling temperature. The hub 200 includes a circuit board 210 that integrates a A83T processor 209, a 24 VAC −5 VDC power supply 201 that connects to the processor 209, a touch panel 202 that connects to the processor 209 via I2C0, a liquid crystal display (LCD) 203 that connects to the processor 209 via a Mobile Industry Processor Interface (MIPI), a type C Universal Serial Bus (USB) 204 that connects to the processor 209 via USB0 interface, a microphone 205 that connects to the processor 209, a ZWAVE module 206 that connects to the processor 209 via a first Universal Asynchronous Receiver/Transmitter (UART), a Bluetooth module 207 that connects to the processor 209 via a second UART, a speaker 208 that connects to the processor 209, a Transflash 211 that connects to the processor 209 via a Secure Digital Input/Output (SDIO) interface, a thermostat 212 that connects to the processor 209 via a third UART and a USB hub 213 that connects to the processor 209 via USB1 interface.

To receive a remote command from over the wide area communications network, the USB hub 213 connects with a cellular module 214 such as SIM7500 and a WiFi 145 module 215 such as BL-8811AU through USB on the circuit board 210. To receive a local command, the touch panel 202 is configured to sense a touch input and the microphone 205 is configured to sense an audio input.

The LCD 203 can display information such as the temperature of a room. The speaker 208 can be used to play music and send alerts or messages. The hub 200 can 150 control the appliances in the room with wired or wireless technologies. The hub 200 allows any input or output through the USB port or the SDIO port of the hub 200.

Figure 3:
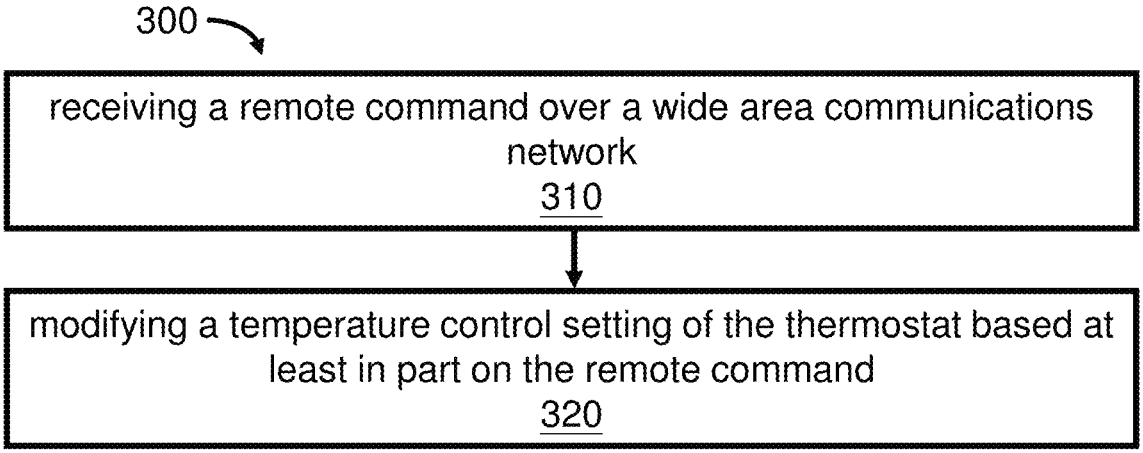
FIG. 3 shows a method for controlling a thermostat in accordance with an example embodiment.

FIG. 3 shows a method for controlling a thermostat in an example embodiment.

Block 310 shows receiving a remote command over a wide area communications network at the thermostat.

By way of example, the wide area communications network is a cellular communications network covering a 3G network, a 4G network, an LTE network, or a 5G network.

By way of example, the method can further include transmitting temperature information over the cellular communications network.

By way of example, the method further includes receiving a local command via a touch screen and modifying the temperature control setting of the thermostat based at least in part on the local command.

By way of example, the method further includes receiving a voice command at the thermostat and modifying the temperature control setting of the thermostat based at least in part on the voice command.

Block 320 shows modifying a temperature control setting of the thermostat based at least in part on the remote command.

By way of example, the method further includes receiving an additional remote command for the appliance over the wide area communications network, in which communicating with the appliance is based at least in part on the additional remote command.

Figure 4:
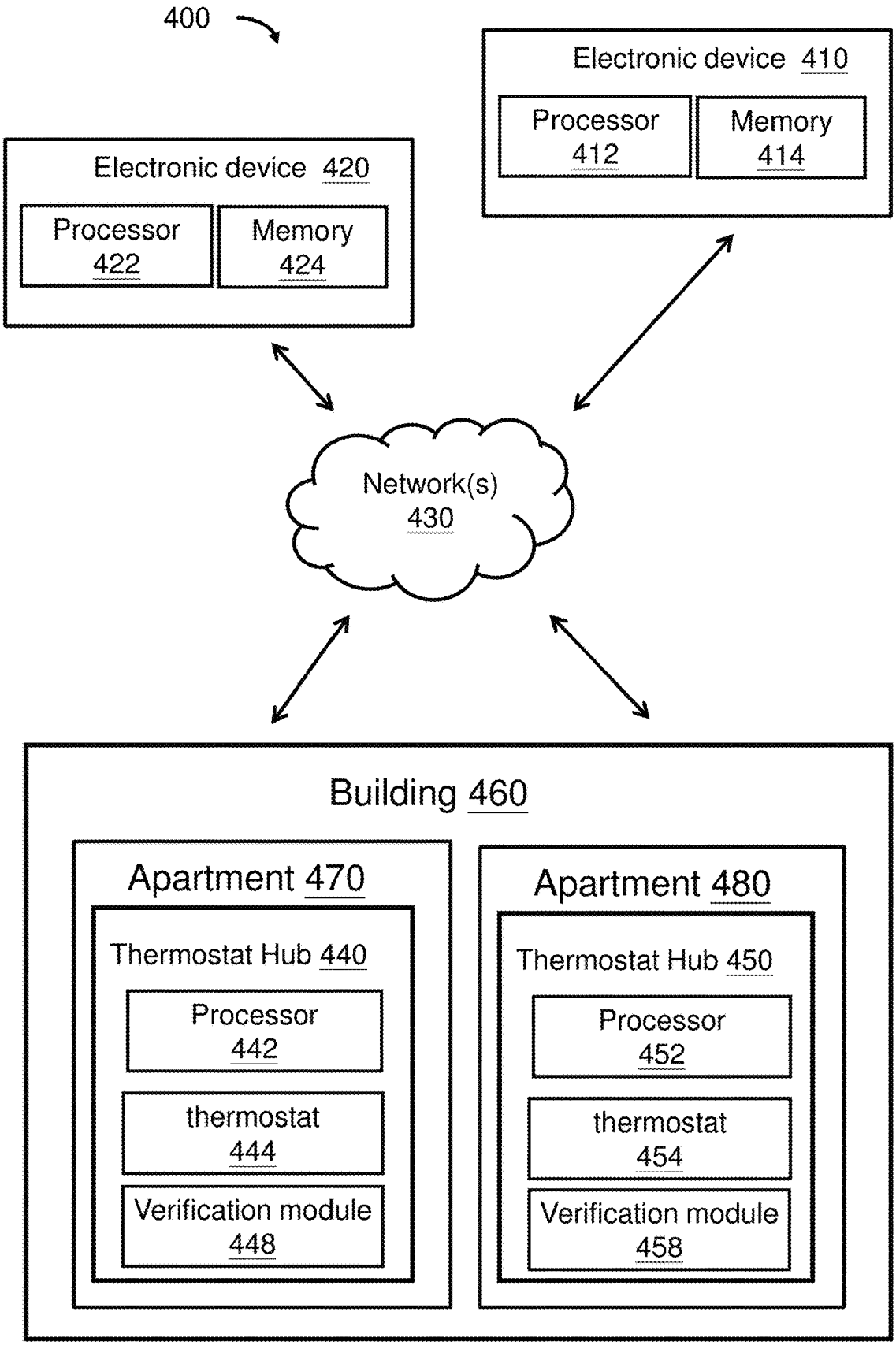
FIG. 4 shows a system for controlling temperature of one or more thermostat hub in a building in accordance with an example embodiment.

FIG. 4 shows a system 400 for controlling a temperature of one or more apartments in a building 460. Each apartment has a thermostat hub. A person chooses to control the thermostat hub 440 in the apartment 470 where a temperature control is desired and the person input in his electronic device 410 to send a wireless remote command over networks 430 to the thermostat hub 440. The processor 442 of the thermostat hub 440 then transforms the wireless remote command into a wired electronic signal and sends the wired electronic signal to the thermostat 444 in the thermostat hub 440 to control the temperature of the apartment 470. By way of example, the wired electronic signal is not an Ethernet signal which is sent through wireless, it is faster and more stable than wireless signal transfer. The system further includes a verification module 448 for verifying an authorization of the wireless remote command, in which controlling the temperature of the apartment using the thermostat 444 is based on the verification. The person can control the thermostat hub 440 by another electronic device 420. The person can control the thermostat hub 450 in another apartment 480 and control the thermostat 454. The person can access to the thermostat hub 450 by another verification module 458. Furthermore, the thermostat hub can include a local communication unit that communicates with one or more appliances in the apartment using a local area network.

The exemplary embodiments of the present invention are thus fully described. Although the description referred to particular embodiments, it will be clear to one skilled in the art that the present invention may be practiced with variation of these specific details. Hence this invention should not be construed as limited to the embodiments set forth herein.

Blocks and/or methods discussed herein can be executed and/or made by a user, a user agent (including machine learning agents and intelligent user agents), a software application, an electronic device, a computer, firmware, hardware, a process, a computer system, and/or an intelligent personal assistant. Furthermore, blocks and/or methods discussed herein can be executed automatically with or without instruction from a user.

The methods in accordance with example embodiments are provided as examples, and examples from one method should not be construed to limit examples from another method. Further, methods discussed within different figures can be added to or exchanged with methods in other figures. Further yet, specific numerical data values (such as specific quantities, numbers, categories, etc.) or other specific information should be interpreted as illustrative for discussing example embodiments. Such specific information is not provided to limit example embodiments.

For example, the touchscreen, the microphone, the temperature control unit, the local communications unit, the cellular communications unit and the processor in FIG. 1 can all be integrated into a single circuit board in the mart thermostat hub 110.

For example, the cellular communications unit communicates with the temperature control unit using a Mini-PCIE interface. The cellular communications unit is configured to communicate with a central processing unit (CPU) of the thermostat via a UART protocol, a USB protocol, or both.

For example, the electronic device 410 in FIG. 4 includes a computer program or software application that performs tasks for the person. Examples of an electronic device include, but not limited to, laptop computers, desktop computers, tablet computers, handheld portable electronic devices, and other portable and non-portable electronic devices.

For example, the networks 430 can include one or more of a wired network, wireless network for communicating one or more signals.

For example, the processor 412, 422, 442, 452 can be CPU, microprocessor, microcontrollers, field programmable gate array, application-specific integrated circuit etc. that controls the overall operation of memory 424, 414 (such as random access memory for temporary storage, read only memory for permanent data storage, firmware etc).

What is claimed is:

1. An apparatus for controlling temperature, comprising:

a processor;

a cellular communications unit in electronic communication with the processor and configured to receive a remote command over a wide area communications network;

a local communications unit communicate with one or more appliances over a local area network;

a temperature control unit configured to modify a temperature control setting based at least in part on the remote command; and a verification module configured to verify an authorization of the remote command, wherein the apparatus houses said processor, said cellular communications unit, said local communications unit and said temperature control unit.

2. The apparatus of claim 1, the apparatus further comprising:

a touchscreen configured receive a local command;

wherein the temperature control unit is further configured to modify the temperature control setting based at least in part on the local command.

3. The apparatus of claim 1, the apparatus further comprising:

a microphone configured to receive a voice command;

wherein the temperature control unit is further configured to modify the temperature control setting based at least in part on the voice command.

4. The apparatus of claim 1, wherein:

the cellular communications unit and the temperature control unit are integrated into a single circuit board.

5. The apparatus of claim 4, wherein:

the cellular communications unit communicates with the temperature control unit using a Mini-PCIE interface.

6. The apparatus of claim 1, wherein:

the cellular communications unit is configured to communicate with a CPU of the thermostat via a UART protocol, a USB protocol, or both.

7. A method for controlling the apparatus of claim 1, comprising:

receiving, at the apparatus, a remote command over a wide area communications network;

verifying an authorization of the remote command;

modifying a temperature control setting of the apparatus based at least in part on the remote command; and communicating with an appliance over a local area network.

8. The method of claim 7, further comprising:

transmitting temperature information over a cellular communications network.

9. The method of claim 7, wherein the wide area communications network is a cellular communications network covering a 3G network, a 4G network, an LTE network, or a 5G network.

10. The method of claim 7, further comprising receiving a local command via a touchscreen; and modifying the temperature control setting of the apparatus based at least in part on the local command.

11. The method of claim 7, further comprising:

receiving an additional remote command for the appliance over the wide area communications network, wherein communicating with the appliance is based at least in part on the additional remote command.

12. The method of claim 7, wherein:

the local area network comprises a WiFi network, a Bluetooth network, a ZigBee network, a WeMo network, a Thread network, or a Z-wave network.

13. The method of claim 7, further comprising:

receiving a voice command at the apparatus; and modifying the temperature control setting of the apparatus based at least in part on the voice command.

14. A method of controlling a temperature of one or more locations comprising receiving, in at least one thermostat hub, a wireless remote command over a cellular communications network;

verifying, in each thermostat hub, an authorization of the wireless remote command, wherein controlling the temperature using the thermostat is based on the verification;

transforming, in a processor provided within the thermostat hub, the wireless remote command into a wired electronic signal; and sending, from the processor to a thermostat provided in the thermostat hub, the wired electronic signal to control the temperature using the thermostat.

15. The method of claim 14, wherein the at least one thermostat hub controls at least one home appliance using a local area network, and wherein the wired electronic signal is not an Ethernet signal.

16. The method of claim 14 further comprising choosing, within a plurality of thermostat hub, a particular thermostat hub in a location where a temperature control is desired.

17. The method of claim 14, wherein the method is applied to an apartment complex with multiple units, and a plurality of thermostat hubs are located in different units.

* * * * *